United States Patent [19]

Erickson

[11] 4,344,340

[45] Aug. 17, 1982

[54] EXTENSIBLE SOCKET WRENCH

[76] Inventor: Wayne Erickson, Rte. 2, Marseilles, Ill. 61431

[21] Appl. No.: 198,721

[22] Filed: Oct. 20, 1980

[51] Int. Cl.[3] ..... B25G 1/04

[52] U.S. Cl. ..... 81/177 A

[58] Field of Search ..... 81/177 A, 177 G, 177 N, 81/436, 439

[56] References Cited

U.S. PATENT DOCUMENTS

| | | | |
|---|---|---|---|
| 1,638,252 | 8/1927 | Fitzgerald, Jr. | 81/177 A X |
| 2,438,633 | 3/1948 | Condor | 81/177 A X |
| 2,963,930 | 12/1960 | Clothier et al. | 81/177 A |

*Primary Examiner*—James G. Smith

*Attorney, Agent, or Firm*—Emrich, Lee, Brown & Hill

[57] ABSTRACT

A socket wrench includes a squares solid rod which non-rotatably interfits within the squared bore of a sleeve. The squared rod has an enlarged head in which a driver releaseably seats. Both the rod and the sleeve are provided with a solid end of squared or other shape to which the attachment end of each of a series of differently sized sockets releaseably catches; and the squared rod includes a spring-biased ball detent which releaseably locks the squared rod to the receiving sleeve in its adjusted position.

6 Claims, 10 Drawing Figures

14
16
18
20
22
24
26
28
30
32
34
36
40
42
44
46
48
50
52
54
58
60
3
4
5
6
8
9
10
12

EXTENSIBLE SOCKET WRENCH

This invention relates to extensible socket wrenches.

Socket wrenches employing an extensible torque member through which the rotational force of a removably located driver can be transmitted to a socket member in order to facilitate tightening or loosening a bolt in its connection which is otherwise not conveniently accessible have been previously patented.

Hurley U.S. Pat. No. 1,493,983 discloses such an extension comprising tubular parts which when assembled in one relation can be used as a short extension and the same parts when differently assembled can be used as a long or maximum extension.

Ayotte U.S. Pat. No. 1,395,887 discloses a hand tool such as a wrench in which the handle was mounted to an inner tube which telescopically fits within an outer tube on which is supported a socket member; and a thumb screw in the outer tube is tightened against a knurled surface or into one of several spaced notches in the inner tube to fix the tubes in an axially adjusted relation. Mandl, U.S. Pat. No. 1,775,402, discloses a wrench outfit comprising a set of different length extension rods which interchangeably connect with one of several crank driving elements. Lyon, U.S. Pat. No. 3,306,639, discloses an extension for a socket wrench comprising a pair of telescoping members in which the outer sleeve supports a springpressed roller which engages in one of several notches spaced axially of the inner rod with which it is aligned to lock the rod to the tube.

In accordance with this invention, a socket wrench comprises a torque transmitting member which is adjustable in length and is automatically stayed in any length to which it is adjusted between a minimum and a maximum.

In its presently preferred form, the torque transmitting member includes an outer sleeve having a squared bore in which non-rotatably fits a complementary-sized squared rod having an enlarged end in which the driven end of a driver releaseably seats.

A feature of the invention is that both the squared inner rod and the receiving outer sleeve have a solid end of such cross-sectional shape that the attachment end of any one of a series of differently sized socket members can be non-rotatably mounted thereto.

The invention contemplates that the squared rod may be used alone to transmit the rotary forces of the driver to the socket member which detachably connects to the opposite or attachment end of the rod. Alternatively, in the event that the head of the bolt to be loosened and/or tightened requires that the driver be located at a greater distance from the socket member than the length of the rod permits, the length of the torque transmitting member can be further increased by inserting the squared rod through the open end of the sleeve and detachably connecting the solid end of the sleeve to the socket member.

A feature of the invention is that means in the form of a spring-biased ball detent is provided at the inserted end of the squared rod which frictionally catches the squared rod to the sleeve in any position to which it is adjusted within the confines of the outer sleeve.

In one form of the invention, said spring-biased ball detent also serves to releaseably lock the socket member to the squared solid end of the rod when it is used independently of the sleeve member.

Another feature of the invention is that the attachment recess comprising the enlarged end of the squared rod is complementary in shape and dimension to the attachment ends of both the rod and the sleeve such that the driver may be interchangeably connected either directly to the socket member or through an extension comprising either the squared rod used alone or the square rod when interfitted within the outer sleeve.

Other objects, advantages, and features of the invention will be at once apparent or will become so upon consideration of the present preferred embodiment of the invention which is illustrated by the accompanying drawings and now described.

Referring first to the drawings.

Figures 1, 2, 3, 4, 5, 6, 7, 8, 9, 10:
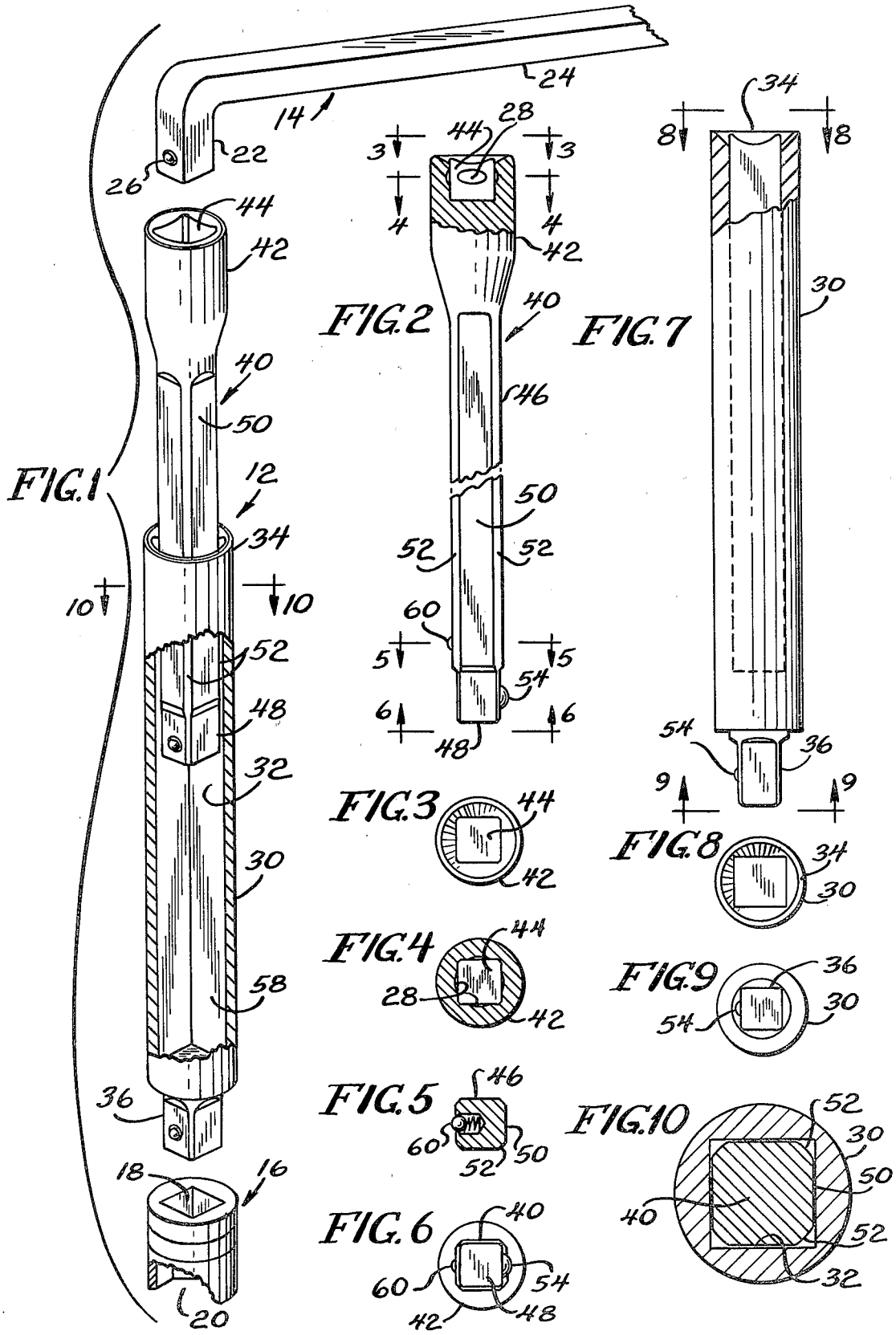
FIG. 1 illustrates the invention embodied in an extensible socket wrench comprising a driver and a socket member connected to opposite ends of an assembled inner rod and outer sleeve which together form an extension or torque transmitting member, portions of its outer sleeve being shown cut away to illustrate details of the assembly.
FIG. 2 is a partially fragmented view of the inner squared rod which is shown in side elevation and separate from the other components of the wrench.
FIG. 3 is an end view of the squared rod taken from a sight line indicated at 3—3 in FIG. 2.

FIGS. 4 and 5 are sectional views taken through the end portions of the squared rod, respectively along lines 4—4 and 5—5 of FIG. 2, looking in the direction indicated by the arrows;

FIG. 6 is an end view taken of the opposite end of the squared rod from a sight line indicated at 6—6 in FIG. 2;

FIG. 7 is a partially fragmented view of the outer sleeve which receives the inner squared rod;

FIGS. 8 and 9 are opposite end views of the outer sleeve, the views being taken from sight lines 8—8 and 9—9 as indicated in FIG. 7; and FIG. 10 is a cross-sectional view taken along line 10—10 of FIG. 1 looking in the direction indicated by the arrows and is shown on an enlarged scale.

Referring now more particularly to the several views wherein like parts are identified by like reference numerals, FIG. 1 illustrates the invention embodied in an extension socket wrench comprising a torque rod or extensible member indicated generally at 12 through which the rotational force of a driver 14 is transmitted to a socket member 16.

As shown best in FIG. 1, socket member 16 has an attachment portion 18 by which it is drivingly connected directly to the driver 14 or through the intermediary of the torque transmitting member 12 as afterwards explained. The opposite side of the socket member 16 contains a nut or bolt head-engaging recess identified at 20. The nut-engaging recess 20 corresponds in size and shape to that of the nut or bolt head to be tightened or loosened and is adapted to be non-rotatably connected therewith. Conventionally, the socket wrench will comprise a series of socket members, each individual socket of the series having a different size and/or shape such that the wrench is useful for loosening or tightening a variety of nuts and/or bolts. Socket member 16 is of conventional construction and it is not considered unique in and of itself.

Driver 14 which is utilized to apply torque to the nut or bolt head is also conventional in construction and as illustrated in FIG. 1, may include a right angled driven end portion 22 and an operating handle 24. Its end portion 22 is suitably shaped and sized such that it is non-rotatably received within the attachment recess 18 of the socket member 16. For example, driver end 22 may have a squared or other polygonal shape as will also characterize the attachment recess 18 of the socket member. Optionally, one wall of said end 22 of the driver 14 contains a spring-biased ball detent 26 which frictionally engages an adjacent side wall of the attachment recess of the socket member and serves to releaseably secure the driver 14 to the socket member 16. In FIG. 1, driver 14 is illustrated as of the socalled manual type, its operating handle 24 being illustrated as disposed at right angles to end portion 22. The driver, however, may be of the motor-driven type in which event its handle may be replaced by an in-line portion which clutches to the motor or an element rotated thereby.

Thus, as afore explained, a rotary force supplied to the driven end 22 of the driver is transmitted directly to the attachment end 18 of the socket member 16 such that by rotating its handle 24 about the axis of end portion 22, the developed rotational force can be applied to the nut or bolt head non-rotatably caught within the recess 20 of the socket member 16.

On occasions, however, there will exist situations wherein there is insufficient room in which to thus operate driver 14 and wherefor this invention includes a torque-transmitting member 12 which connects between the driver end 22 and the socket member 16. As illustrated in FIG. 1, said torque-transmitting member 12 consists of an outer sleeve member 30 having a central bore 32 of squared, hex or other polygonal cross-section which opens through one end 34 of the sleeve and is closed at its opposite end by an attachment end 36 which may also be squared and/or polygonal in cross-section and otherwise shaped to releaseably fit within the complementary shaped attachment recess 18 of the aforementioned socket member 20. The torque-transmitting member also includes an inner solid rod 40 which is inserted through the open end 34 of the sleeve 30 and is shaped to non-rotatably fit with the complementary shaped central bore of sleeve 30 which is preferably squared. Said inner solid rod 40 has an enlarged end portion 42 which protrudes beyond the open end of the sleeve and contains in its upper reaches, a squared or other polygonal-shaped attachment recess 44 into which the driver end 22 of driver 14 is inserted. The size and cross-sectional shape of said attachment recess 44 corresponds to the dimensions and shape of the terminal end of the driver so that said driver end 22 snugly and non-rotatably fits therein. Preferably, said terminal or driven end of driver 14 is also provided with a spring-biased ball detent 26 which releaseably engages in correspondingly located notches 28 provided in the side wall of the attached recess 44.

As aforedescribed, the main body 46 of the inner rod 40 between its enlarged end 42 and attachment end 48 has a squared or other polygonal shape corresponding to that of the central bore of the sleeve 30 so that one does not rotate relative to the other. Preferably, as illustrated, the flat surfaces 50 of the solid rod 40 do not form sharp corners at their intersections and instead, said surfaces merge along rounded edges 52 which facilitate assembly of the rod within the sleeve 30.

In accordance with this invention, the inner solid rod 40 also includes an attachment end 48 which is given a squared or other polygonal shape such that it snugly but detachably connects within the attachment recess 18 of the socket member 20. Preferably, said reduced end 48 of the solid rod 40 also contains a spring-biased ball detent at 54 which frictionally engages the corresponding side wall 18 of the socket member 16 when assembled therewith.

Referring again to FIGS. 2 and 5, the solid rod 40 may be provided with a second spring-biased ball detent illustrated at 60 which frictionally engages the adjacent side surfaces 58 of the bore in outer sleeve 30 into which the rod is inserted.

In this form of the invention, the attachment end portion 48 of rod 40 may be of smaller cross-section to enable it to fit the receiving attachment recess 18 of socket 16 and a second ball detent 60 is located in the larger cross-section main body 46 of the rod and preferably, in a wall portion of said rod opposite diametrically to the location of the first ball detent 54.

In another form of the invention, the spring-biased ball detent 60, is omitted and reliance is placed upon the spring-biased ball detent 54 in the attachment end portion 48 of the rod 40 so that it serves both to releaseably lock said attachment end portion 48 within the receiving attachment end 18 of the socket member 16 and when assembled with sleeve 30 also frictionally stays the assembled rod 40 and sleeve 30 in the selected axial adjusted length. In this alternate form, ball detent 54 necessarily is somewhat enlarged and more space is provided behind the corresponding flat side 46 of said rod 40. When both spring-biased ball detents 54 and 60 are utilized, they are preferably so located as to engage opposite walls of the sleeve bore 32.

As thus described, it will be appreciated that an extensible socket wrench of unique structure is provided and one which has utility such that a rotational force exerted on the driver 14 may be transmitted directly through its terminal end to the socket member 20 in order to tighten or loosen the bolt in its connection. Under other circumstances, the driver may be connected to the attachment end 44 of the torque-transmitting solid rod in which circumstance the rotational movement imparted to the driver 14 can be transmitted through rod 40 to the socket member 16 via its attachment end 48 which seats in the attachment recess 18 of the socket member. When an even greater reach of the socket wrench is required, then the rod 40 can be assembled in the open end 34 of the outer sleeve 30 which, in turn, has an attachment end 36 assembled within the attachment recess 18 of socket member 20. In the latter arrangement, the torque imparted to the driver 14 is transmitted through the rod 40 to the outer sleeve 30 and, in turn, through its attachment end 36 to the attached socket member 16. The squared or polygonal shape of the torque-transmitting rod 40 complements the squared or polygonal shape of the sleeve bore 32 whereas the spring-biased ball detent 60 and/or 54 serve to frictionally locate the torque-transmitting rod within a wide range of adjusted lengths.

Thus, it will be appreciated that the construction of an extensible socket wrench in accordance with the invention is structurably simple so as to present a minimum of manufacturing problems and at the same time, it demonstrates considerable utility in providing a torque-transmitting member capable of an infinite number of axial adjustments to accommodate the needs of a mechanic or other workman utilizing it.

Thus, having described the invention, I claim:

1. An extensible socket wrench comprising, in combination, a sleeve having a polygonal bore which opens through one end thereof, the opposite end of the sleeve embodying a solid attachment portion which detachably and non-rotatably seats in a complementary sized and shaped attachment recess of each of a series of socket members;

a polygonal solid rod which fits and is axially slidable in said polygonal bore of the sleeve through the open end thereof;

said polygonal solid rod having an enlarged end portion containing an attachment recess in which is non-rotatably received the complementary sized and shaped terminal end of a driver;

the opposite end of the polygonal solid rod containing a spring-biased ball detent which yieldably engages an interior side of the sleeve bore and automatically secures the polygonal solid rod to the sleeve in all positions to which it is adjustable in the sleeve between a maximum and minimum; and said opposite end of the polygonal rod having an attachment portion of a size and shape complementing the attachment recess of the socket members such that the polygonal solid rod may itself be detachably connected to the socket member and serve to transmit the rotational force of the driver exerted thereon to the socket member.

2. The extensible socket wrench of claim 1 wherein the spring-biased ball detent in the opposite end of the polygonal solid rod frictionally engages the inner wall of a socket member when the opposite end of the solid rod is assembled therewith.

3. An extensible socket wrench as claimed in claim 1 further including a socket member having a nut engaging recess and an attachment recess, the attachment end of the socket being selectively receptive to the attachment portions of the sleeve end of the solid rod.

4. An extensible socket wrench as claimed in claim 1 wherein the cross-section of the recess in the enlarged end of the polygonal solid rod corresponds to the cross-section of the attachment portion of the sleeve.

5. An extensible torque transmission member for a socket wrench comprising a sleeve having a squared bore, one end being open and its opposite end embodying a closed solid attachment end which non-rotatably seats within the attachment recess of a socket member;

a squared solid rod member which telescopically fits in and is axially slidable through said open end of the sleeve;

said squared solid member having an enlarged end portion containing an attachment recess corresponding in size and shape to the closed solid attachment end of the sleeve which non-rotatably seats within the attachment recess of the socket member;

the squared solid rod member containing a spring-biased ball detent which frictionally engages with the interior wall of the sleeve to retain the solid rod member assembled therewith;

said spring-biased ball detent also serving to frictionally retain a socket member when assembled to the squared rod member; and the said spring-biased ball detent being contained within the opposite end of the squared rod member, said opposite end being of cross-section less than that of the main body of the squared rod member; and the ball detent being sufficiently great to engage the interior wall either of the attachment recess of a socket member or of the bore of the sleeve in which it is assembled.

6. An extensible torque transmission member for a socket wrench comprising a sleeve having a squared bore, one end being open and its opposite end embodying a closed solid attachment end which non-rotatably seats within the attachment recess of a socket member;

a squared solid rod member which telescopically fits in and is axially slidable through said open end of the sleeve;

said squared solid member having an enlarged end portion containing an attachment recess corresponding in size and shape to the closed solid attachment end of the sleeve which non-rotatably seats within the attachment recess of the socket member; and the squared solid rod member having an attachment end portion which non-rotatably seats within the attachment recess of a socket member, a first spring-biased ball detent which serves to frictionally stay the squared solid member within the sleeve when inserted therein, and a second spring-biased ball detent which frictionally retains the attachment portion of the squared rod member in the attachment recess of a socket member with which it is assembled.

* * * * *